US005685098A

United States Patent [19]

Wegrzyn

[11] Patent Number: 5,685,098

[45] Date of Patent: Nov. 11, 1997

[54] SNAP TAB ARRANGEMENT FOR COVERING AND UNCOVERING A SIGN APPARATUS DIRECTIONAL INDICATOR

[75] Inventor: Joseph Wegrzyn, Stratford, Conn.

[73] Assignee: General Signal Corporation, Stamford, Conn.

[21] Appl. No.: 557,902

[22] Filed: Nov. 14, 1995

Related U.S. Application Data

[63] Continuation of Ser. No. 238,227, May 4, 1994, abandoned.

[51] Int. Cl.[6] ..... G09F 13/04

[52] U.S. Cl. ..... 40/570; 40/580; 220/787; 403/345

[58] Field of Search ..... 40/541, 570, 576, 40/580, 579, 620, 622; 220/284, 285, 307, 787; 403/345, 375, 380

[56] References Cited

U.S. PATENT DOCUMENTS

| | | | |
|---|---|---|---|
| 2,504,850 | 4/1950 | Lermer | 220/787 |
| 3,396,269 | 8/1968 | Sorenson | 220/307 X |
| 3,883,973 | 5/1975 | Goodman | 40/620 |
| 4,355,479 | 10/1982 | Thronton | 40/570 |
| 4,421,246 | 12/1983 | Schultz et al. | 220/307 |
| 5,005,759 | 4/1991 | Bouche | 220/307 |
| 5,247,756 | 9/1993 | Johnstone | 40/570 |
| 5,285,917 | 2/1994 | Hofmann | 220/307 |

FOREIGN PATENT DOCUMENTS

| | | | |
|---|---|---|---|
| 631051 | 12/1949 | United Kingdom | 40/622 |

*Primary Examiner*—Peter M. Cuomo
*Assistant Examiner*—James O. Hansen
*Attorney, Agent, or Firm*—Ohlandt, Greeley Ruggiero & Perle

[57] ABSTRACT

An illuminated exit sign having at least one chevron-shaped opening on its outer surface and a replaceable directional arrow cover that is substantially similar in shape to the opening and removable from the opening in order to selectively indicate an exit direction. A shoulder which is formed in the cover is adapted to abut with a shoulder formed at the opening. At least two snap tabs located on opposite sides of the arrow cover fit securely within corresponding notches disposed in the shoulder formed at the opening. The opposing configuration of the shoulders and the corresponding configuration of the snap tabs and notches facilitate the removal and replacement of the arrow by a single, quick snapping action which secures the cover in a snug, flush fit.

2 Claims, 2 Drawing Sheets

SNAP TAB ARRANGEMENT FOR COVERING AND UNCOVERING A SIGN APPARATUS DIRECTIONAL INDICATOR

RELATED APPLICATION

This is a continuation of application Ser. No. 08/238,227, filed on May 4, 1994, now abandoned.

BACKGROUND OF THE INVENTION

I. Field of the Invention

This invention relates to sign apparatus that may be configured to indicate a particular direction to anyone who views the sign apparatus. In particular, this invention relates to an exit sign having a directional indicator that may be modified each time its environment or location necessitates such a change.

Exit signs are often located in buildings that open to the public and used to indicate the closest or most convenient direction for one to travel in order to exit from the building. Where the exit sign is mounted directly above a passageway, the direction of travel is obvious and a directional indicator located on the exit sign is not necessary. In situations where the direction of travel is not obvious, the exit sign may have a directional indicator, such as an arrow, pointing in the general direction one should travel in order to successfully find an exit passageway or otherwise exit the building.

II. Description of the Prior Art

Exit signs are generally known in the art to have left or right openings in the shape of directional arrows on their front surface. These exits signs have back-lighting sources that emit light through the openings in order to illuminate the directional arrow shape of the openings to those people who are within viewing range of the exit sign. The openings may be preformed during the fabrication of the exit sign or formed subsequently by an installer, just before he or she installs the sign at a desired location. Exit signs that allow the installer to form the openings just before installation have been more desirable to the installers, since such exit signs may be customized at any time to have left and/or right directional arrows depending upon the requirements of their installed location.

An exit sign having a directional arrow that is insertable as well as reusable is disclosed in U.S. Pat. No. 5,247,756 to Johnstone, which issued on Sep. 28, 1993. For insertion, the directional arrow is equipped with an edge snap rail positioned remotely from a tongue such that the snap rail is inserted into a mating bead on the sign only after the tongue is slid downward and hooked into a mating notch of the sign. Thus, this two-step insertion process of slidably hooking the tongue into the notch and snapping the snap rail into the bead requires a reasonable degree of skill and concentration. The removal of the directional arrow from the exit sign also requires a two-step process, i.e., the snap rail is first snapped reversely and then, subsequently, the tongue is slid upwardly from the notch.

SUMMARY OF THE INVENTION

An object of the present invention is to provide a novel and improved sign apparatus having directional arrows and corresponding directional arrow openings that are more durable, easier to use and cheaper to manufacture than the directional arrow indicators of the prior art.

Another object of the present invention is to provide a novel and improved sign apparatus having directional arrows that may be inserted into directional arrow openings of the sign apparatus by way of a quick, simply inwardly directed, snapping action which secures the cover in a snug, flush fit. Similarly, the directional arrows of the sign apparatus may be removed from the directional arrow openings by way of a snapping action, similar to the insertion procedure.

Yet another object of the present invention is to provide directional arrows for a sign apparatus that may be snapped into directional arrow openings of the sign apparatus with minimal effort and skill.

Still another object of the present invention is to provide at least two snap tabs located on opposite sides of each directional arrow that fit securely within corresponding notches disposed in each directional arrow opening.

In fulfillment of the above stated objects, and in accordance with the present invention, a sign apparatus is provided having an opaque stencil, the stencil having an outer surface containing a pattern of openings for an illuminated sign which in operation acts to illuminate the pattern in the stencil, at least one of the openings having a direction-indicating shape which is adapted to be obscured by a cover, the improvement which comprises the cover having a shape substantially identical to the opening so as to fit snugly into the opening and flush with the outer surface; at least two notches located on respective spaced edges of the opening and arranged substantially opposite each other; and at least two snap tabs mounted on the edges of the cover for snapping directly into the notches upon insertion of the cover into the opening, wherein either one of the at least two snap tabs snap to, and unsnap from, the notches irrespective of the position of the other one of the snap tabs relative to the notches. In another embodiment of the present invention, the application of substantial pressure to the inner surface of the cover solely causes the cover to be released completely from said opening.

DETAILED DESCRIPTION OF THE PREFERRED EMBODIMENT

The sign apparatus and directional arrow indicators of the present invention are applicable to any circumstance where a directional indicator would provide assistance to those in search of a certain location. The following description of the preferred embodiment, i.e., an exit sign, is provided by way of example and completeness of description.

Figure 1:
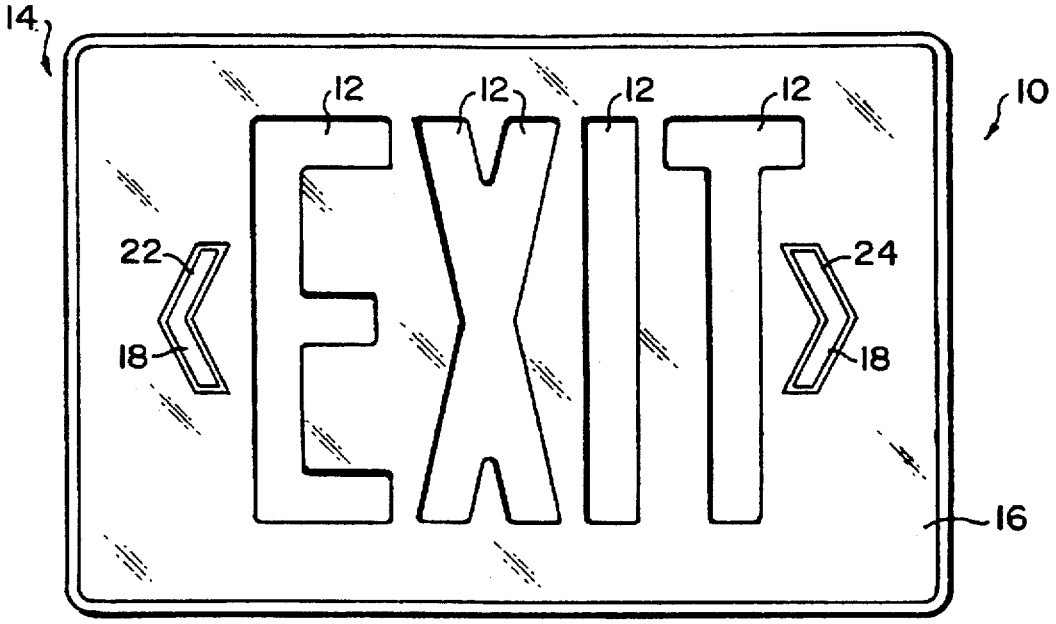
FIG. 1 is a plan view showing the outer surface of the sign apparatus of the preferred embodiment of the present invention.

Referring to the figures and, in particular, FIG. 1, there is shown a preferred embodiment of the sign apparatus, such as an exit sign, having a stencil embodying the present invention and generally represented by reference numeral 10. The apparatus may assume any suitable form, as for example, the form shown in U.S. Pat. No. 5,247,756, which issued on Sep. 28, 1993, and is incorporated herein by reference.

In general, a plurality of openings, voids or perforations 12, 18, and 22 of various shapes and sizes form a stencil image 14 in the stencil 10 located at the front part of the outer surface 16 of the sign apparatus. A light source (not shown) is positioned behind the stencil 10 so as to illuminate the stencil image 14 through the openings 12, 18, and 22. The openings 12 may be in the form of a word, such as "EXIT", or direction-indicating opening 18 and 22, such as a chevron-shaped arrow, as shown in the preferred embodiment of FIG. 1.

In accordance with the present invention, each direction-indicating opening 18 and 22 is adapted to receive a direction-indicating cover 20 of substantially identical shape and dimension. The direction-indicating cover 20 is discussed subsequently in detail in reference to FIGS. 5 through 8. The substantially common shape of the cover 20 and its corresponding opening 18 and 22 provides a snug fit which effectively blocks the passage of light through the opening 18 and 22. In addition, the shape of the cover 20 and the opening 18 and 22 may be designed for easy detachment of the cover from the opening by either a manual means or the assistance of a flat-tipped tool (not shown), such as a screwdriver.

The direction-indicating openings 18 and 22 of the preferred embodiment are each of substantially identical construction. The direction-indicating openings 18 and 22 shown in FIG. 1 are differentiated only by their positions: one opening 18 points to the left of the sign apparatus whereas the other opening points to the right 22 of the sign apparatus. Although the rest of this description shall concentrate on only the left direction-indicating opening 18 for the sake of convenience, the following discussion regarding the left direction-indicating opening 18 may also apply to the construction of other direction-indicating openings of the preferred embodiment, including the right direction-indicating opening 22.

Figure 2:
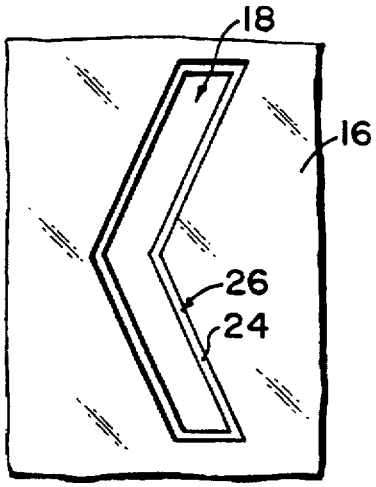
FIG. 2 is a plan view showing a magnified view of the left arrow opening of FIG. 1.

FIG. 2 is a close-up plan view of the left direction-indicating opening 18 on the outer surface 16 of the stencil 10, showing one side 24 of an inner shoulder 26 and the from part of outer or front surface 16 of the stencil 10 which partially define the outer boundary of the direction-indicating opening 18. The inner shoulder 26 is formed at the inner portion of the direction-indicating opening 18 such that the aforementioned side 24 of the inner shoulder 26 is formed a fixed distance away from the outer surface 16 of the stencil 10, like a receded surface, as shown in FIG. 2, whereas the other side 28 is flush with the inner surface 30, shown in FIG. 3.

Figure 3:
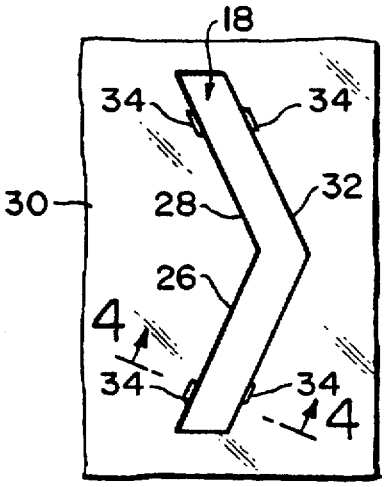
FIG. 3 is a plan view showing an opposite view of the left arrow opening of FIG. 2, i.e., viewing the opening from the inner surface of the sign apparatus.

FIG. 3 is a plan view of the shoulder-side of the direction-indicating opening 18 on the inner surface 30 of the stencil 10. From this view, the inner shoulder 26 is shown to be flush with the inner surface 30 of the stencil 10, and a dash line 32 indicates the outer perimeter of the directional indicating opening 18 on the outer surface 16 (not shown in FIG. 3) of the stencil 10. In addition, four notches 34 in the inner shoulder or bead 26 define the four snap elements 36 (shown in FIG. 4) that are located in an inside peripheral portion 38 (shown in FIG. 4) of the direction-indicating opening 18.

Figure 4:
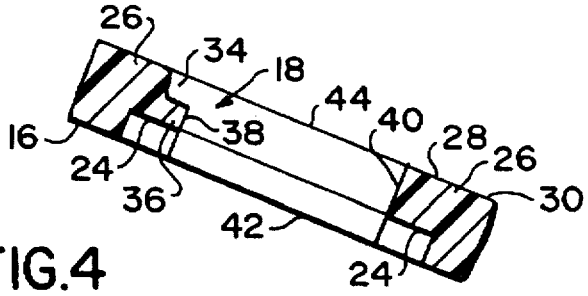
FIG. 4 is a cross sectional view of the left arrow opening taken along line B—B of FIG. 3.

The location of the various elements of the direction-indicating opening 18 in relation to one another is clearly shown in the cross sectional view of FIG. 4. As shown in this figure, an inner shoulder 26 reduces the inner volume of the opening 18 for a substantial portion of the opening. As stated above, one side 28 of the inner shoulder 26 is flush with the inner or back surface 30 whereas the other side 24 is an inner surface that is located at a level that is between the front and back surfaces 16 and 30. Thus the thickness of the inner shoulder 26, defined by an inner peripheral edge 40, is less than the thickness of the entire opening 18. Due to the position of this inner shoulder 26, the aperture 42 at the outer surface 16 of the opening 18 is slightly larger than the aperture 44 at the inner surface 30 of the opening.

Also shown in FIG. 4 is a cross sectional view of one of the notches 34 in the inner shoulder 26. Although these notches 34 may vary in quantity and size, the preferred embodiment includes four notches made in selected portions of the inner shoulder 26 that extend the aperture 44 of the inner surface 30 beyond the inner peripheral edge 40 of the inner shoulder 26. Since the notch 34 only removes part of the inner shoulder 26, the remaining portion of the inner shoulder that is located between the notch and the inner peripheral edge 40 is referred to as a snap element 36. Thus, the formation of the four notches 34 in the inner shoulder 26 simultaneously forms four snap rails 36 within the direction-indicating opening 18 of the preferred embodiment.

Figure 5:
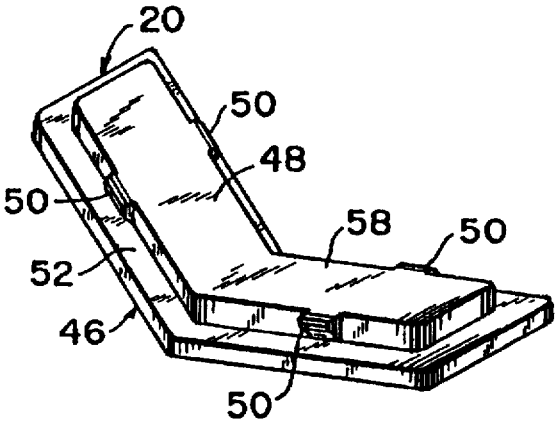
FIG. 5 is a perspective view of an arrow cover of the preferred embodiment of the present invention that may be inserted into, and removed from, the left or right arrow openings of FIG. 1.

It will be appreciated that each direction-indicating opening 18 is adapted to receive a direction-indicating cover 20 of substantially identical shape and dimension. A preferred embodiment of the cover 20 having a chevron-shaped boundary is shown in FIG. 5. The cover 20 comprises three integral portions: an outer layer 46, inner layer 48 and snap tabs 50. The outer layer 46 and inner layer 48 are combined such that the outer boundary of the outer layer 46 extends from the boundaries of the inner layer 48, thus forming a cover shoulder 52 along the perimeter of the cover 20. It should be noted that the outer and inner layers 46 and 48 may be formed separately, but preferably, the two layers should formed as one single, unibody layer in order to have a more rugged construction.

The proximity of the snap tabs 50 in relation to each other allows for the direction-indicating cover 20 to be inserted into, and removed from, a corresponding direction-indicating opening 18 with the utmost ease and convenience. By locating each pair of snap tabs 50 in close proximity of each other, both snap tabs for each pair will evenly distribute any pressure and undergo substantially the same amount of pressure when insertion or removal is attempted manually. This effect is possible as long as the distance between each pair of snap tabs 50 is not substantially further apart than the human finger or thumb (not shown) that applies pressure to the direction-indicating cover 20. Thus, even though each snap tab 50 requires a nominal amount of pressure in order to pass over a snap element 36, each pair of snap tabs of the preferred embodiment provides much more support for holding a direction-indicating cover 20 within a direction-indicating opening 18 while retaining much of the benefit of the nominal pressure requirements.

The stencil and the direction-indicating covers 20 of the present invention may comprise of any type of material that is suitable for signs that display information. The snap elements 36 of the sign apparatus should be made of a resilient material that is substantially rigid to support the snap tabs 50 within their corresponding notches 34 and yet slightly flexible in order to allow the snap tabs to ingress and egress the notches. For the purposes of economical and efficient manufacturing, the stencil 10 may have a unibody, rugged construction and the direction-indicating covers 20 may have a similar material composition as the stencil. Preferably, the stencil 10 and covers 20 may comprise a precision molded, engineering grade thermal plastic that is impact resistant, scratch resistant and corrosion proof. The molding process of the thermal plastic allows for a color selection of the stencil 10 such that color of the stencil contrasts the color of the stencil image 14 for easy viewing when in use.

Figure 6:
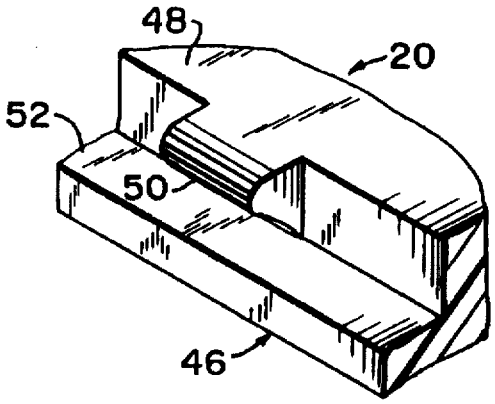
FIG. 6 is a perspective magnified view of one of the snap tabs of the arrow cover of FIG. 5.

A close-up view of one of the snap tabs 50 of FIG. 5 is shown in more detail in FIG. 6. The snap tabs 50 are formed on the outer perimeter of the inner layer 48 of the cover 20. The snap tabs 50 are elongated and substantially half-cylindrical in shape, and located a set distance away from the shoulder 52 of the outer layer 46. This area separating the snap tabs 50 from the shoulder 52 provides room for the aforementioned snap element 36 to fit when the direction-indicating cover 20 is inserted into the direction-indicating opening 18. Even though the shape of the snap tabs 50 may vary, the outer perimeter of the snap tab should be tapered somewhat in order to allow the snap tab to slide past a corresponding snap element 36.

Figure 7:
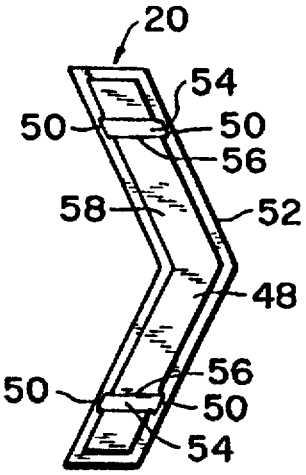
FIG. 7 is a elevation view of an alternate embodiment of the arrow cover.

Referring to FIG. 7, an alternate embodiment of the snap tabs is shown. Instead of having the snap tabs 50 integrated as part of the unibody construction of the direction-indicating cover 20 as described above, this alternate embodiment forms two snap tabs on a single snap tab support 54 such that the snap tab support is mounted within a cut-out groove 56 in the inner layer 48. This configuration not only ties a direct support link between opposing snap tabs 50, but in addition, provides a flexible design that is more efficient to manufacture and allows for simple replacement of snap tabs when necessary.

Figure 8:
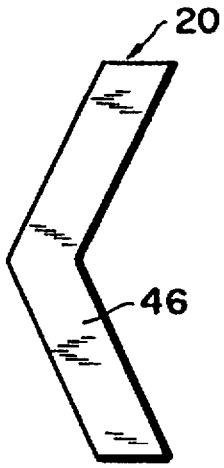
FIG. 8 is another elevation view of the arrow cover, taken from the side opposite the side shown in FIG. 7.

Referring to FIG. 8, an elevation view of the direction-indicating cover 20 is shown opposite the side view of FIG. 7. By comparing the perimeter of the cover 20 shown in FIGS. 7 and 8 with the perimeter of the opening 18 shown in FIGS. 3 and 2, respectively, these figures clearly show that the cover has a shape that is substantially identical to the opening so as to fit snugly into the opening and flush with the outer surface 16 of the stencil 10.

Referring back to FIG. 4, the direction-indicating cover 20 fits snugly into the direction-indicating opening 18 when the snap tab supporting side 58 of the cover is inserted through the aperture 42 of the outer surface 16 and the snap tab 50 is snapped into the notch 34 of the opening. As the snap tab 50 snaps over a substantial potion of the snap element 36 of the opening 18, the shoulder 52 of the outer layer 46 of the cover 20 abuts the inner surface 24 of the inner shoulder 26 of the opening. Thus, the shoulder 52 of the cover 20 and the inner surface 24 of the opening 18 support the cover within the opening in one direction, while the snap tab 50 of the cover and the snap element 36 of the opening support the cover within the opening in the other direction. Although the amount of support in both directions is not equal, even the weaker support is sufficient for the purposes of the sign apparatus of the preferred embodiment.

The invention having been thus described with particular reference to the preferred forms thereof, it will be obvious that various changes and modifications may be made therein without departing from the spirit and scope of the invention as defined in the appended claims.

Wherefore, I claim:

1. A sign apparatus having an opaque stencil, said stencil having an outer surface containing a pattern of openings for an illuminated sign which in operation acts to illuminate said pattern in said stencil, at least one of said openings having a direction-indicating chevron shape; and a cover for obscuring said opening, the improvement which comprises:

said cover having a shape substantially identical to said one opening so as to fit snugly therein and flush with the outer surface of said stencil, said cover comprising two identical portions each having two parallel edges; each cover portion including (1) an outer layer forming a first shoulder extending to said parallel edges to define an outer periphery, (2) an inner body layer having two parallel edges, located inwardly of the respective two parallel edges which define said outer periphery, from which two snap tabs respectively project laterally in opposite directions; the entire cover thereby having four snap tabs;

means for securing said cover in said opening, said means including said four snap tabs disposed solely within the outer periphery defined by the four parallel edges; a second shoulder extending inwardly at the corresponding edges of said opening for engaging said first shoulder of each cover portion; four notches at the second shoulder for receiving the respective tabs, said four notches defining snap elements with said second shoulder;

said snap tabs being arranged such that they snap into, and unsnap from, said notches responsive solely to a force applied substantially transversely of said opaque stencil, whereby said cover is completely secured to and released from said opening upon application of said force.

2. A sign apparatus having an opaque stencil as defined in claim 1, in which said two snap tabs project laterally in line and oppositely from the inner body layer of each cover portion.

* * * * *